US007398836B2

(12) United States Patent
Elmvist et al.

(10) Patent No.: US 7,398,836 B2
(45) Date of Patent: Jul. 15, 2008

(54) PNEUMATIC POWER TOOL WITH ADJUSTABLE EXHAUST AIR OUTLET DETECTOR

(75) Inventors: Karl Stefan Elmvist, Upplands Väsby (SE); Mikael John Nordström, Johanneshov (SE); Torbjörn Gunnar Walheim, Stockholm (SE)

(73) Assignee: Atlas Copco Tools AB, Nacka (SE)

( * ) Notice: Subject to any disclaimer, the term of this patent is extended or adjusted under 35 U.S.C. 154(b) by 81 days.

(21) Appl. No.: 10/542,871

(22) PCT Filed: Jan. 23, 2004

(86) PCT No.: PCT/SE2004/000086

§ 371 (c)(1),
(2), (4) Date: Mar. 20, 2006

(87) PCT Pub. No.: WO2004/065070

PCT Pub. Date: Aug. 5, 2004

(65) Prior Publication Data

US 2006/0225905 A1 Oct. 12, 2006

(30) Foreign Application Priority Data

Jan. 23, 2003 (SE) ..... 0300153

(51) Int. Cl.
*B25D 17/14* (2006.01)

(52) U.S. Cl. ..... 173/218; 173/93.5; 173/168; 173/DIG. 2; 173/170; 173/171

(58) Field of Classification Search ..... 173/93.5, 173/168, 169, 170, 171, 218, DIG. 2; 181/230, 181/226, 212, 232, 239, 240
See application file for complete search history.

(56) References Cited

U.S. PATENT DOCUMENTS

| | | | | | |
|---|---|---|---|---|---|
| 2,414,638 | A | * | 1/1947 | Dobie | 418/1 |
| 3,472,323 | A | * | 10/1969 | Hall | 173/221 |
| 4,962,787 | A | | 10/1990 | Mayhew | |
| 5,309,714 | A | * | 5/1994 | Putney et al. | 173/219 |
| 5,383,771 | A | * | 1/1995 | Ghode et al. | 418/15 |
| 5,725,142 | A | | 3/1998 | Hamada | |
| 6,158,528 | A | | 12/2000 | Izumisawa | |
| 6,634,438 | B1 | * | 10/2003 | Pusateri et al. | 173/93.5 |
| RE39,009 | E | * | 3/2006 | Izumisawa | 173/168 |

* cited by examiner

*Primary Examiner*—Louis K. Huynh
*Assistant Examiner*—Michelle Lopez
(74) *Attorney, Agent, or Firm*—Frishauf, Holtz, Goodman & Chick, P.C.

(57) ABSTRACT

A pneumatic power tool includes a housing, a motor, a pressure air inlet passage, an exhaust air outlet passage, and an exhaust air outlet flow deflector. The exhaust air outlet flow detector includes an outlet piece with radial as well as axial outlet openings and a valve element with radial as well as axial apertures. The outlet piece and the valve element are rotatable relative to the housing as well as to each other to bring a radial opening of the outlet piece into or out of alignment with a radial aperture of the valve element (21), and at the same time to bring the axial apertures of the valve element out of or into alignment with the openings of the outlet piece, thereby shifting the exhaust outlet flow direction as desired between a radial direction and an axial direction.

6 Claims, 1 Drawing Sheet

PNEUMATIC POWER TOOL WITH ADJUSTABLE EXHAUST AIR OUTLET DETECTOR

This application is a U.S. National Phase Application under 35 USC 371 of International Application PCT/SE2004/000086 filed Jan. 23, 2004.

The invention relates to a pneumatic power tool provided with an exhaust air outlet deflector rotatably supported on the tool housing for selectively changing the outlet flow direction from the housing.

A problem concerned with prior art power tools of the above type relates to the limited optional ways of directing the exhaust air outlet flow from the tool. In many tool applications, the operation position and orientation of the tool makes it difficult for the operator to avoid being hit by the outlet flow, which sometimes is very annoying and uncomfortable.

The main object of the invention is to provide a pneumatic power tool of the above type having a rotatively adjustable outlet flow deflector by which the exhaust air outlet flow from the tool may be directed in different radial directions as well as in the axial direction of the tool housing.

Another object of the invention is to provide a pneumatic power tool of the above mentioned type provided with an adjustable outlet flow deflector which gives a number of optional ways to direct the outlet flow from the housing and which is simple in design and easy to operate.

Further advantages and characteristic features of the invention will appear from the following specification wherein a preferred embodiment of the invention is described in detail with reference to the accompanying, drawings.

In the drawings

Figure 1:
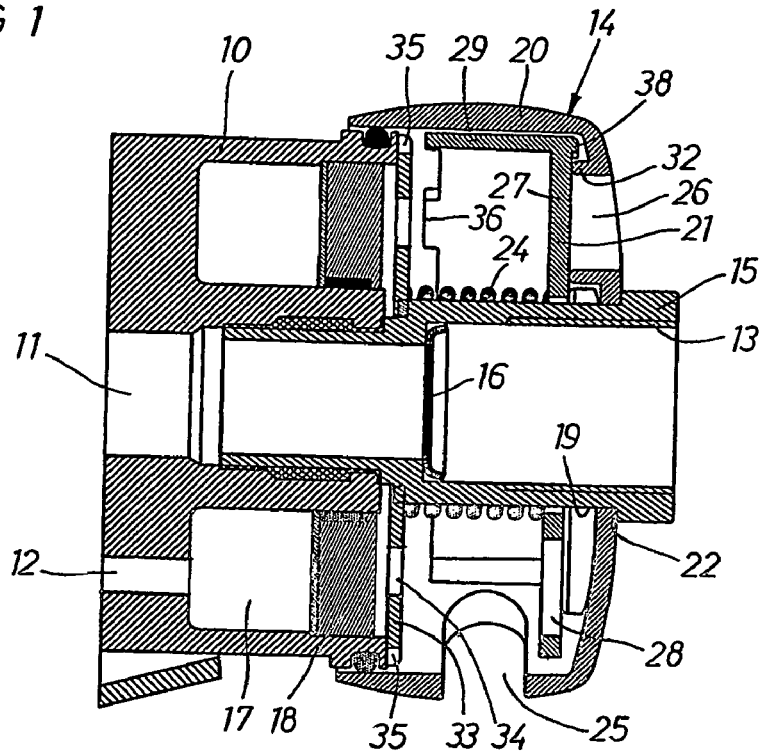
FIG. 1 shows a longitudinal section through an outlet deflector according to the invention.

The power tool illustrated in FIG. 1 comprises a housing 10, a pneumatic motor (not shown), a pressure air inlet passage 11 and an exhaust air outlet passage 12 communicating with the motor, and an adjustable exhaust air outlet deflector 14. The inlet passage 11 is arranged to be connected to a pressure air conduit via tubular inlet socket 15 threaded into the rear end of the housing 10. At its outer end the inlet socket 15 is provided with an internal thread 13 for connection to a conduit nipple. A gauze screen 16 is provided in the inlet socket 15 for straining off particles from the pressure air flow. The outlet passage 12 comprises a sound attenuating expansion chamber 17 and a porous material silencer element 18 for reducing the exhaust noise from the tool.

The inlet socket 15 comprises a cylindrical surface 19 which forms a part of the outlet deflector 14. On the cylindrical surface 19 there are supported a cup-shaped outlet piece 20 and a valve element 21. Both of the outlet piece 20 and the valve element 21 are rotatively as well as axially displaceable relative to the socket 15 and the housing 10, and an annular shoulder 22 at the outer end of the socket 15 forms an axial support for the outlet piece 20. A spring 24 exerts a bias force on the valve element 21 and the outlet piece 20 to maintain the latter in contact with the shoulder 22 and to accomplish a contact pressure between the valve element 21 and the outlet piece 20. The socket 15 forms a mounting means for the entire outlet deflector 14 and is provided with a hex grip for a tightening tool.

Figure 2:
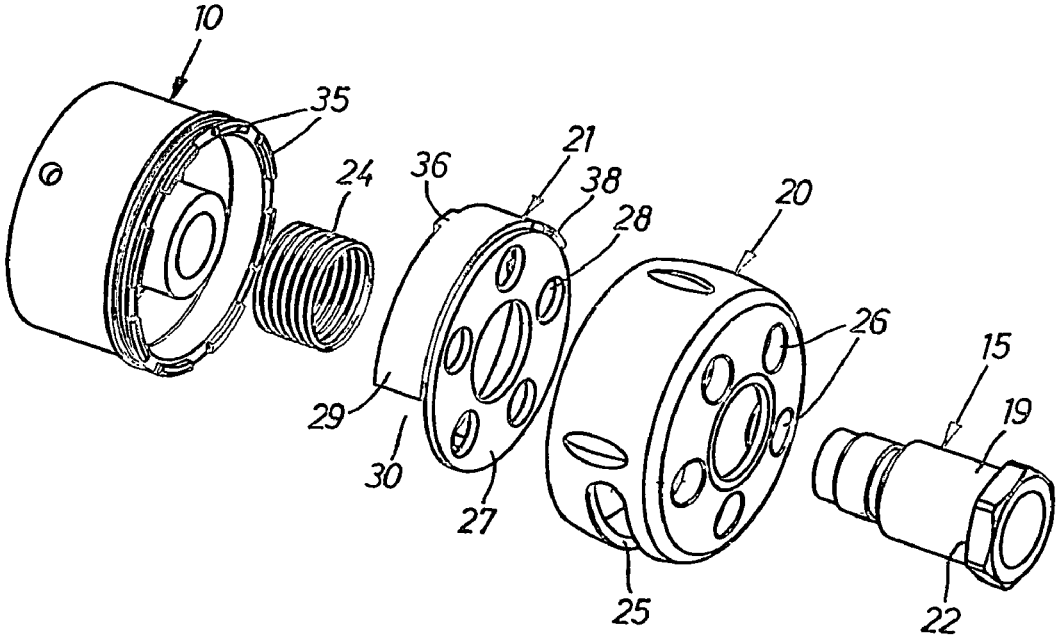
FIG. 2 shows an exploded perspective view of the outlet deflector in FIG. 1.

The outlet piece 20 is provided with one radially directed outlet opening 25, and five axially directed outlet openings 26 arranged in a certain symmetric pattern. The valve element 21 comprises a flat transverse wall portion 27 with five apertures 28 arranged in a pattern congruent with pattern of the outlet openings 26 of the outlet piece 20. The valve element 21 comprises a part-cylindrical wall portion 29 leaving a radial aperture 30 (see FIG. 2) to be aligned with the radial opening 25 of the outlet piece 20 as desired.

The axial apertures 28 and the radial aperture 30 of the valve element 21 are located in such a way relative to the openings 25 and 26, respectively, of the outlet piece 20 that when the axially directed openings 26 of the outlet piece 20 coincide with the apertures 28 in the valve element 21, the radial opening 25 of the outlet piece 20 is covered and closed by the wall portion 29 of the valve element 21, i.e. the aperture 30 does not at all coincide with the opening 25. This means that you can have either an axially directed outlet flow or a radially directed outlet flow.

As can be seen in FIG. 1, each one of the openings 26 is surrounded on its inside by an annular shoulder 32 forming a friction surface to be contacted by the wall portion 27 of the valve element 21. By the frictional engagement between the valve element 21 and the outlet piece 20 there may be accomplished a joint rotation of the outlet piece 20 and the valve element 21 when rotating the outlet piece 20.

At its rear end, the housing 10 comprises a transverse wall element 33 having a number of exhaust flow openings 34. The wall element 33 is also provided with a circumferential row of coupling teeth 35 which are intended to be engaged by a rearwardly directed tooth 36 on the valve element 21. This engagement takes place when the valve element 21 is manually displaced rearwardly via the outlet piece 20, against the bias force of the spring 24. When positively coupled to the housing 10 vi a the teeth 35,36 the valve element 21 is locked against rotation whereas the outlet piece 20 still can be rotated by a torque exceeding the continuously acting frictional resistance between the outlet piece 20 and the valve element 21. A forwardly directed tooth 38 on the valve element 21 is arranged to co-operate with two abutments (not illustrated) on the outlet piece 20 so as to limit the relative rotation between the outlet piece 20 and the valve element 21 and to define the two relative end positions between the outlet piece 20 and the valve element 21 as described below.

By rotating the outlet piece 20 relative to the valve element 21 between the two end positions there is obtained a shifting between a radially directed outlet flow and an axially directed outlet flow, i.e. a shifting between

- a first relative position of the outlet piece 20 and the valve element 21 wherein the apertures 28 in the valve element 21 fully coincide with the axially directed openings 26 of the outlet piece 20 in the valve element 21, whereas at the same time the radial aperture 30 of the valve element 21 is totally out of alignment with the radial opening 25 of the outlet piece 20, and
- a second relative position in which the radial aperture 30 of the valve element 21 fully coincides with the radial opening 25 in the outlet piece 20, whereas at the same time the axially directed apertures 28 in the valve element 21 not at all coincide with the axially directed openings 26 in the outlet piece 20.

When, however, the outlet piece 20 and the valve element 21 occupy their second relative positions and the outlet piece 20 is not axially displaced towards the housing, the outlet piece 20 and the valve element 21 may be rotated jointly by frictional interengagement, thereby changing the direction of the radial outlet flow through the opening 25 and aperture 30 in any desired direction.

When desired to change the direction of the outlet flow from a radial direction to the axial direction, the outlet piece 20 is pressed towards the housing 10 and rotated. Thereby, the teeth 36 of the valve element 21 and the teeth 35 of the wall element 33 are engaged to lock the valve element 21, and the outlet piece 20 may be rotated alone to the above mentioned first relative position defined by the teeth 38 on the valve element 21 and the non-illustrated abutments in the outlet piece 20. In this position, the radial opening 25 is brought out of alignment with the aperture 30 of the valve element 21, whereas the axially directed openings 26 of the outlet piece 20 fully coincide with the apertures 28 of the valve element 21.

When desired to change back to a radial outlet flow direction, the outlet piece 20 is again pressed axially towards the housing 10 making the tooth 36 of the valve element 21 engage the teeth 35 on the wall element 33, whereby the valve element 21 is locked against rotation and the outlet piece 20 may be rotated to the second relative position defined by the tooth 38 and the non-illustrated abutments of the outlet piece 20. Then a full coincidence is obtained between the opening 25 on the outlet piece 20 and the aperture 30 on the valve element 21, whereas the axially directed openings 26 are out of alignment with the apertures 28 of the valve element 21.

It is to be understood that the embodiments of the invention are not limited to the above described example but can be freely varied within the scope of the claims.

The invention claimed is:

1. A pneumatic power tool, comprising a housing, a motor, a pressure air inlet passage and an exhaust air outlet passage, and an adjustable exhaust air outlet deflector rotatably supported on said housing wherein said outlet deflector comprises:

a cup-shaped outlet piece having at least one radially directed outlet opening, and at least one axially directed outlet opening arranged in a certain pattern; and a valve element which is rotatably supported in a co-axial relationship with said outlet piece, and which has at least one axially directed aperture arranged in a pattern congruent with said certain pattern of said at least one axially directed outlet opening of said outlet piece, and at least one radially directed aperture to be selectively brought into alignment with said at least one radially directed outlet opening of said outlet piece;

wherein said outlet piece and said valve element are rotatable relative to each other between:

a first relative position at which said at least one axially directed aperture of said valve element coincides fully with said at least one axially directed outlet opening of said outlet piece, and at which said at least one radially directed aperture of said valve element does not at all coincide with said at least one radially directed outlet opening of said outlet piece, such that the outlet deflector directs outlet flow of exhaust air axially through the coinciding at least one axially directed aperture and at least one axially directed outlet opening; and a second relative position at which said at least one radially directed aperture of said valve element coincides fully with said at least one radially directed outlet opening of said outlet piece, and at which said at least one axially directed aperture of said valve element does not at all coincide with said at least one axially directed outlet opening of said outlet piece, such that the outlet deflector directs the outlet flow of the exhaust air radially through the coinciding at least one radially directed aperture and at least one radially directed outlet opening.

2. The power tool according to claim 1, wherein said outlet piece and said valve element are axially displaceable relative to the housing, and a spring is arranged to bias said valve element against said outlet piece so as to frictionally couple said valve element relative to said outlet piece to enable joint rotation of said outlet piece and said valve element for adjusting an exhaust flow outlet direction from the outlet deflector in said second relative positions; and wherein a coupling mechanism is provided between said valve element and the housing for positively locking said valve element against rotation when said valve element is displaced axially against the housing by said outlet piece against a bias force of said spring, thereby enabling said outlet piece to be rotated relative to said valve element between said first relative position and said second relative position, despite the frictional coupling between said outlet piece and said valve element.

3. The power tool according to claim 1, wherein said air inlet passage comprises an inlet socket secured to the housing and extending co-axially through said outlet piece and said valve element, and an annular shoulder on said inlet socket forms an axial bearing surface for said outlet piece.

4. The power tool according to claim 3, wherein said valve element is located inside said outlet piece.

5. The power tool according to claim 2, wherein said air inlet passage comprises an inlet socket secured to the housing and extending co-axially through said outlet piece and said valve element, and an annular shoulder on said inlet socket forms an axial bearing surface for said outlet piece.

6. The power tool according to claim 5, wherein said valve element is located inside said outlet piece.

* * * * *

UNITED STATES PATENT AND TRADEMARK OFFICE

CERTIFICATE OF CORRECTION

PATENT NO. : 7,398,836 B2
APPLICATION NO. : 10/542871
DATED : July 15, 2008
INVENTOR(S) : Karl Stefen Elmqvist et al.

It is certified that error appears in the above-identified patent and that said Letters Patent is hereby corrected as shown below:

On the Title Page:

Item (12), line 2, change "Elmvist et al" to --Elmqvist et al--

Item (54), line 3, change "DETECTOR" to --DEFLECTOR--

Item (75), Inventors, line 1, change "Elmvist" to --Elmqvist--

Item (30), Foreign Application Data, line 2, change "0300153" to --0300153-4--

Signed and Sealed this

Sixteenth Day of February, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,398,836 B2
APPLICATION NO. : 10/542871
DATED : July 15, 2008
INVENTOR(S) : Karl Stefen Elmqvist et al.

It is certified that error appears in the above-identified patent and that said Letters Patent is hereby corrected as shown below:

On the Title Page:

Item (12), line 2, change "Elmvist et al" to --Elmqvist et al--

Item (54), line 3, change "DETECTOR" to --DEFLECTOR--

Item (75), Inventors, line 1, change "Elmvist" to --Elmqvist--

Item (30), Foreign Application Data, line 2, change "0300153" to --0300153-4--

Column 1, line 3, change "DETECTOR" to --DEFLECTOR--

This certificate supersedes the Certificate of Correction issued February 16, 2010.

Signed and Sealed this

Twenty-third Day of March, 2010

David J. Kappos

David J. Kappos
*Director of the United States Patent and Trademark Office*